US009241581B2

(12) United States Patent
O'Nion

(10) Patent No.: US 9,241,581 B2
(45) Date of Patent: Jan. 26, 2016

(54) ADJUSTABLE PAD

(76) Inventor: Laurie O'Nion, Carlton, OR (US)

( * ) Notice: Subject to any disclaimer, the term of this patent is extended or adjusted under 35 U.S.C. 154(b) by 0 days.

(21) Appl. No.: 13/540,487

(22) Filed: Jul. 2, 2012

(65) Prior Publication Data

US 2013/0025063 A1 Jan. 31, 2013

Related U.S. Application Data

(60) Provisional application No. 61/503,611, filed on Jun. 30, 2011.

(51) Int. Cl.
*A47D 15/00* (2006.01)
*A47D 5/00* (2006.01)

(52) U.S. Cl.
CPC ..... *A47D 5/006* (2013.01); *A47D 15/003* (2013.01)

(58) Field of Classification Search
CPC ..... A47D 5/006; A47D 15/003; A47D 9/005; A47G 9/1027; A47G 2009/003; A47G 9/062; A61G 7/1021; A47C 27/10; A47C 7/021
USPC ..... 5/655, 657, 652, 632, 634, 615, 655.3, 5/654, 655.4, 644, 420, 945, 953
See application file for complete search history.

(56) References Cited

U.S. PATENT DOCUMENTS

| | | | | | |
|---|---|---|---|---|---|
| 1,726,939 | A | * | 9/1929 | Anderson | 267/117 |
| 3,568,225 | A | * | 3/1971 | Radke | 5/653 |
| 3,680,917 | A | | 8/1972 | Harris | |
| 3,763,509 | A | | 10/1973 | Mittendorf | |
| 3,775,785 | A | * | 12/1973 | Mittendorf | 5/640 |
| 3,811,140 | A | * | 5/1974 | Burpo | 5/632 |
| 4,171,549 | A | | 10/1979 | Morrell et al. | |
| 4,607,403 | A | | 8/1986 | Alivizatos | |
| 4,667,356 | A | | 5/1987 | Holmquist | |
| 4,685,163 | A | * | 8/1987 | Quillen et al. | 5/710 |
| 4,697,290 | A | | 10/1987 | Alklind et al. | |
| 4,934,002 | A | | 6/1990 | Watanabe | |
| 4,962,553 | A | | 10/1990 | Marquis | |
| 5,002,014 | A | | 3/1991 | Albin | |

(Continued)

FOREIGN PATENT DOCUMENTS

| | | | |
|---|---|---|---|
| CN | 201499931 | U | 6/2010 |
| CN | 201759231 | U | 3/2011 |

(Continued)

OTHER PUBLICATIONS

Contour Living, "Backmax Body Wedge Cushion Sets", "Backmax Body Wedge Cushion Sets", Oct. 9, 2004, Publisher: Contour Living.

(Continued)

*Primary Examiner* — David E Sosnowski
*Assistant Examiner* — Eric Kurilla
(74) *Attorney, Agent, or Firm* — West & Associates, A PC; Stuart J. West; Shaun N. Sluman

(57) ABSTRACT

An adjustable pad that can have a substantially level top regardless of the slope or configuration of the surface it is placed upon. The adjustable pad can have a sheet coupled with one or more support members. The support members can be formed or adjusted to account for the slope of the surface. The adjustable pad can be used to change a child's diaper, as a sleeping pad, or for other desired reasons, regardless of the configuration of the surface.

8 Claims, 18 Drawing Sheets

(56) References Cited

U.S. PATENT DOCUMENTS

| | | | | |
|---|---|---|---|---|
| 5,079,786 | A * | 1/1992 | Rojas | 5/654 |
| 5,088,139 | A * | 2/1992 | Bloom | 5/420 |
| 5,154,649 | A | 10/1992 | Pender | |
| 5,182,828 | A | 2/1993 | Alivizatos | |
| 5,303,435 | A | 4/1994 | Haar et al. | |
| 5,345,630 | A | 9/1994 | Healy | |
| 5,392,477 | A * | 2/1995 | Wolter et al. | 5/413 AM |
| 5,632,055 | A | 5/1997 | Graf | |
| D389,359 | S * | 1/1998 | Nowak | D6/601 |
| 5,711,041 | A | 1/1998 | Chen | |
| 5,852,838 | A | 12/1998 | Johnson | |
| 5,899,529 | A | 5/1999 | Chaucer | |
| 5,924,661 | A | 7/1999 | Chernack | |
| 5,970,550 | A | 10/1999 | Gazes | |
| 6,125,487 | A * | 10/2000 | Ive | 5/655 |
| 6,170,908 | B1 * | 1/2001 | Jewell | 297/118 |
| D446,676 | S | 8/2001 | Mayes | |
| 6,298,511 | B1 | 10/2001 | Collymore | |
| 6,381,787 | B1 * | 5/2002 | Rogone et al. | 5/655 |
| 6,561,582 | B1 | 5/2003 | Steadman | |
| 6,601,252 | B1 * | 8/2003 | Leach | 5/632 |
| 6,665,893 | B2 | 12/2003 | Fruge | |
| 6,671,900 | B2 * | 1/2004 | Davis | 5/118 |
| 6,691,348 | B2 | 2/2004 | Plummer et al. | |
| 6,754,920 | B2 * | 6/2004 | Fleming et al. | 5/420 |
| D504,270 | S * | 4/2005 | Lowenthal | D6/604 |
| 6,971,127 | B2 * | 12/2005 | Richards | 5/108 |
| 7,007,328 | B1 | 3/2006 | Bailey | |
| 7,007,330 | B2 | 3/2006 | Kuiper et al. | |
| D523,679 | S * | 6/2006 | Illingworth | D6/601 |
| 7,059,000 | B2 * | 6/2006 | Verbovszky | 5/655 |
| 7,127,762 | B1 * | 10/2006 | Lau | 5/713 |
| 7,231,681 | B2 | 6/2007 | Kasatshko et al. | |
| 7,305,728 | B2 * | 12/2007 | Schlieps | 5/657 |
| 7,346,951 | B1 * | 3/2008 | Heaton | 5/715 |
| 7,497,513 | B2 * | 3/2009 | Kim | 297/180.11 |
| 7,509,699 | B1 | 3/2009 | Tresenfeld | |
| 7,607,185 | B1 | 10/2009 | Minson | |
| 7,735,170 | B1 | 6/2010 | Emerson | |
| 7,757,320 | B2 * | 7/2010 | Lord et al. | 5/655 |
| 7,761,944 | B2 * | 7/2010 | Skophammer | 5/655 |
| 8,181,295 | B1 * | 5/2012 | Mallinger | 5/710 |
| 8,276,227 | B2 * | 10/2012 | Pileggi | 5/640 |
| 8,419,128 | B1 * | 4/2013 | Leach | 297/219.12 |
| 8,671,480 | B1 * | 3/2014 | Leach | 5/632 |
| 2001/0040402 | A1 * | 11/2001 | Odderson | 297/452.21 |
| 2003/0037379 | A1 * | 2/2003 | Gibson et al. | 5/655.3 |
| 2004/0025254 | A1 | 2/2004 | McCarthy | |
| 2005/0210593 | A1 * | 9/2005 | Stackman et al. | 5/655 |
| 2006/0016013 | A1 * | 1/2006 | Lord et al. | 5/655 |
| 2006/0053552 | A1 * | 3/2006 | Peterson et al. | 5/413 R |
| 2006/0080779 | A1 * | 4/2006 | Munro | 5/655 |
| 2007/0122066 | A1 * | 5/2007 | Landay | 383/16 |
| 2008/0016623 | A1 | 1/2008 | Gold et al. | |
| 2008/0172795 | A1 * | 7/2008 | Straub | 5/655 |
| 2008/0216245 | A1 * | 9/2008 | Liners | 5/654 |
| 2009/0126117 | A1 | 5/2009 | Lazarus | |
| 2009/0151080 | A1 * | 6/2009 | Lord | 5/655 |
| 2011/0000023 | A1 * | 1/2011 | Kennedy | 5/655 |
| 2011/0119832 | A1 * | 5/2011 | Hung | 5/655 |

FOREIGN PATENT DOCUMENTS

| | | | |
|---|---|---|---|
| KR | 20110002819 | A | 1/2011 |
| TW | 201012422 | A | 4/2010 |
| TW | 201036579 | A | 10/2010 |

OTHER PUBLICATIONS

EXPED, "EXPED Synmat 7 Deluxe Air Pad With Built-In Hand Pump", "EXPED Synmat 7 Deluxe Air Pad With Built-In Hand Pump", 2006, Publisher: EXPED.

Thermarest, "Z Seat", "Z Seat", Apr. 29, 2009, Publisher: Thermarest.

Top of the Line, "Baby Seat Changer", "Baby Seat Changer", Nov. 11, 2006, Publisher: Top of the Line.

* cited by examiner

ADJUSTABLE PAD

CLAIM OF PRIORITY

This Application claims priority under 35 U.S.C. §119(e) from earlier filed U.S. Provisional Application Ser. No. 61/503,611, filed Jun. 30, 2011, by Laurie O'Nion, the entirety of which is incorporated herein by reference.

BACKGROUND

1. Field of the Invention

The present device relates to the field of childcare accessories, particularly a portable diaper changing pad apparatus that can be used on a variety of surfaces.

2. Background

Parents and other caregivers often need to change childrens' diapers. This need can sometimes arise suddenly while a caregiver and child are in an inconvenient location, such as a public place where no suitable changing location can be found. The caregiver can need to improvise and position the child on a less than ideal surface while changing the child's diaper. In some situations this can be uncomfortable for the child, as well as awkward for the caregiver.

Existing diaper changing pads can be useful when the caregiver is away from home, because they can provide a sanitary mobile station for caring for a child. However, many existing diaper changing pads are designed to be spread out on a flat level surface, and therefore can have limited effectiveness in other situations. For example, a caregiver can find it necessary to change a child's diaper on a sloped surface such as a vehicle seat or piece of furniture. The caregiver can also need to change a child's diaper on a variable and/or sloped surface, such as rough, bumpy ground outdoors. If a level surface is found, in some situations the surface can be too hard to provide comfort to the child during the diaper changing process.

What is needed is an adjustable pad that can conform to a variety of different types and/or configurations of surfaces in order to provide a level, cushioning, and/or stabilizing support platform for a child when the child's diaper needs to be changed, regardless of the location or type of surface that must be used. The adjustable pad can also be used in non-childcare situations, such as allowing a user to sleep on the adjustable pad while camping on uneven and/or uncomfortable ground, rest items on the adjustable pad regardless of the characteristics of the surface, or use the adjustable pad in any other type of situation.

DETAILED DESCRIPTION

Figure 1A:
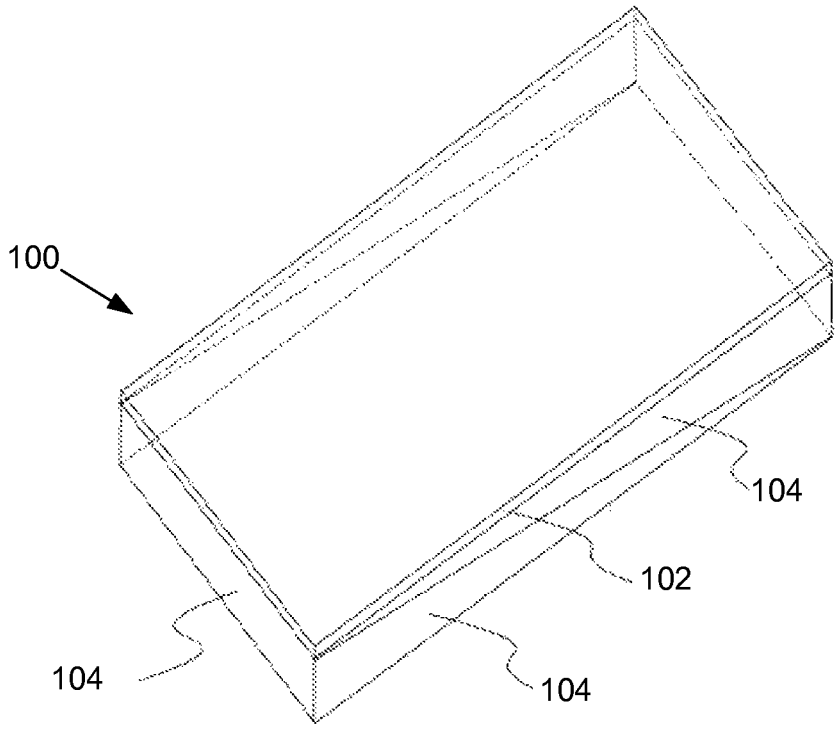
FIGS. 1*a* and 1*b* depict isometric views of embodiments of a diaper changing pad.
Figure 1B:
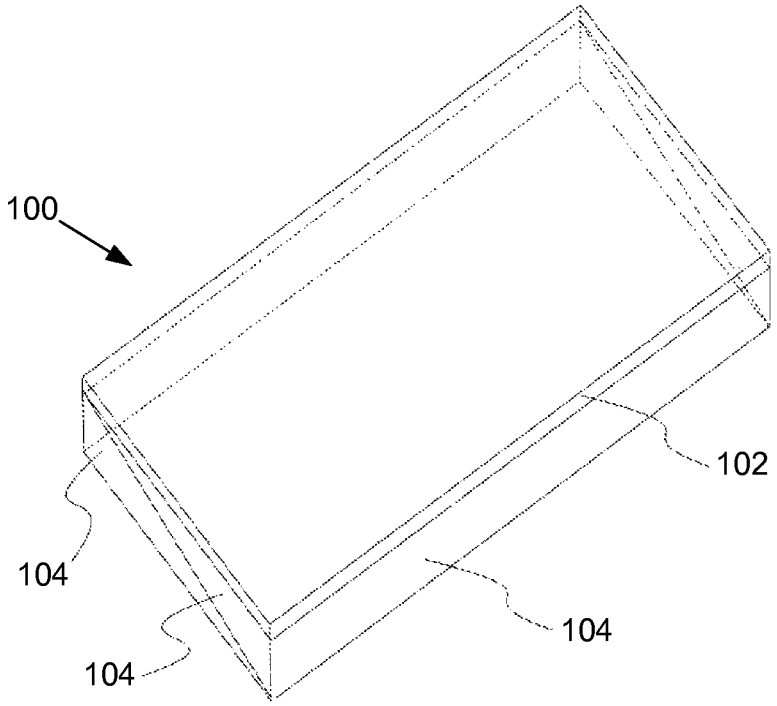

FIGS. 1*a* and 1*b* depict isometric views of embodiments of an adjustable pad 100. The adjustable pad 100 can comprise a sheet 102 coupled with at least one support member 104.

Figure 2A:
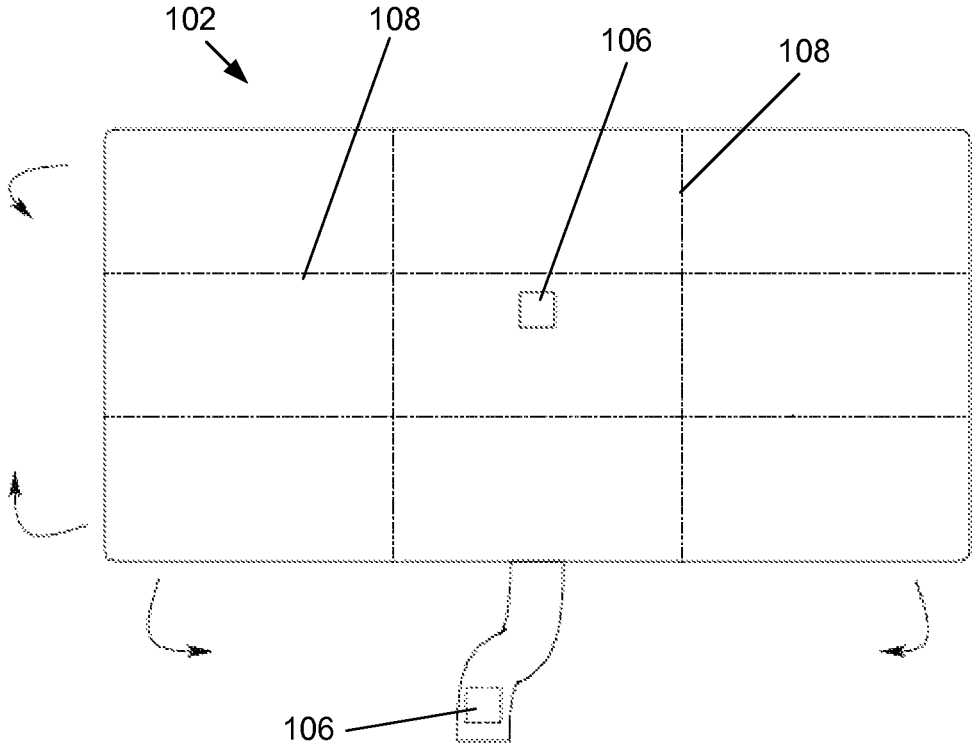
FIGS. 2*a* and 2*b* depict embodiments of the sheet.
Figure 2B:
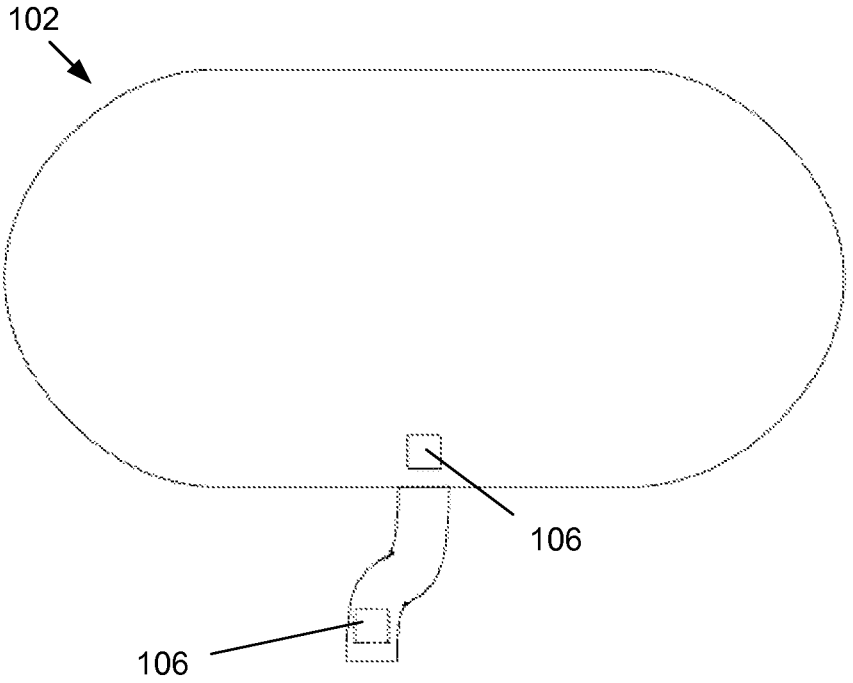

FIGS. 2*a* and 2*b* depict embodiments of the sheet 102. The sheet 102 can be a substantially planar member having a top side and a bottom side. In some embodiments, the sheet 102 can be substantially rectangular, as shown in FIG. 2*a*. In other embodiments, the sheet 102 can have curved edges, as shown in FIG. 2*b*. In still other embodiments, the sheet 102 can have an ovoid shape, polygonal shape, or any other desired shape. In some embodiments, the sheet 102 can be comprised of a flexible material, such as a polymer, neoprene, textile, foam, plastic, or any other desired material. In some embodiments, the sheet 102 can be comprised of a washable and/or fluid-resistant material. In some embodiments, the sheet 102 can be folded, rolled, or otherwise deformed into a smaller package for storage, transport, and/or any other reason. In some embodiments, the sheet 102 can comprise one or more connectors 106 that can be fastened after the sheet 102 has been folded, rolled, or otherwise deformed to keep the sheet 102 in the smaller package. The connectors 106 can be hook and loop fasteners, snaps, buttons, straps, clips, strings, and/or any other desired fasteners. In some embodiments, the sheet 102 can comprise one or more fold portions 108. The fold portions 108 can be sections of the sheet 102 that can be more pliable than other sections of the sheet 102, such that the sheet 102 can be folded along the fold portions 108.

Figure 3A:
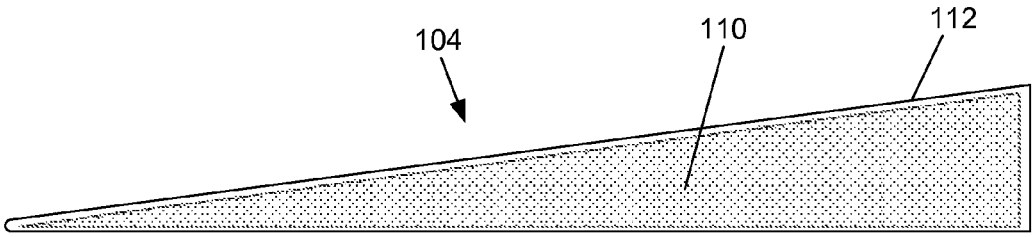
FIGS. 3*a* and 3*b* depict cross sections of embodiments of the support members.
Figure 3B:
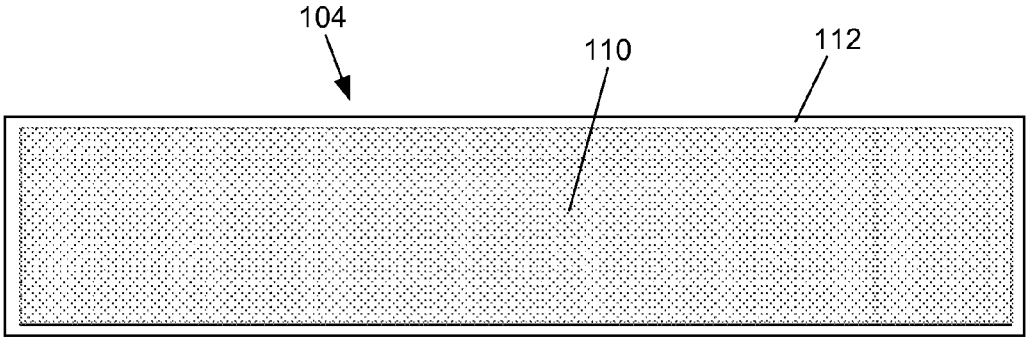

FIGS. 3*a* and 3*b* depict cross sections of embodiments of the support members 104. In some embodiments, the support members 104 can have a wedge shape with a triangular cross section, as shown in FIG. 3*a*. In some of these embodiments, the cross section can be of a right triangle with a hypotenuse side, a long leg, and a short leg. In other embodiments, the support members 104 can have a rectangular cross section, as shown in FIG. 3*b*. In still other embodiments, the support members 104 can have an at least partially ovoid cross section, polygonal cross section, and/or have any other shape or cross section shape. In some embodiments, the support members 104 can be deformable into any desired shape or configuration.

In some embodiments, the support members 104 can comprise a central body 110. The central body 110 can be comprised of closed-cell foam, open-cell foam, polymer, polystyrene, neoprene, wood, plastic, metal, and/or any other desired material. In some embodiments, the central body 110 can be at least partially porous and/or deformable. In some embodiments the central body 110 can be uncovered, but in other embodiments the central body can be at least partially surrounded by a casing 112. The casing 112 can be comprised of plastic, polymer, paper, textile, neoprene, paper, and/or any other desired material. In some embodiments, the casing 112 can be comprised of a washable and/or fluid-resistant material. In some embodiments, the casing 112 can be stretchable. In other embodiments, the casing 112 can have accordion-style folds, such that the casing 112 can be expanded and contracted. In alternate embodiments, the casing 112 can be static, rigid, non-stretchable, deformable, pliable, and/or have any other known or desired qualities.

Figure 4A:
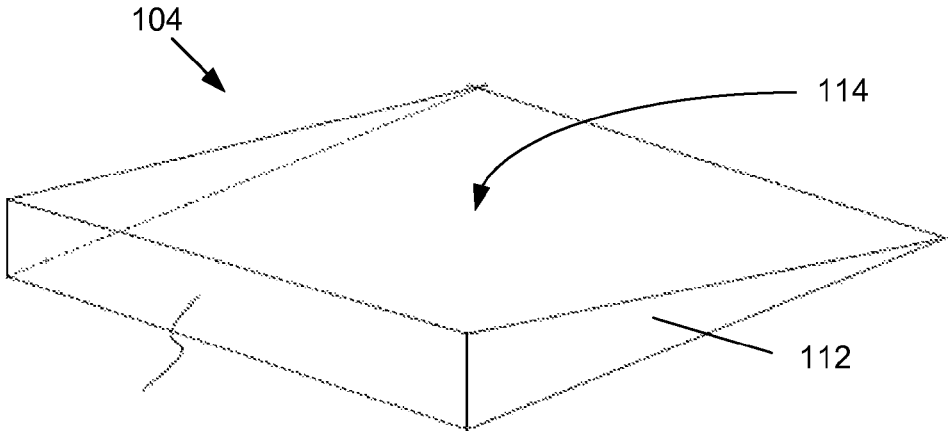
FIGS. 4*a*-4*c* depict embodiments of the support members.
Figure 4B:
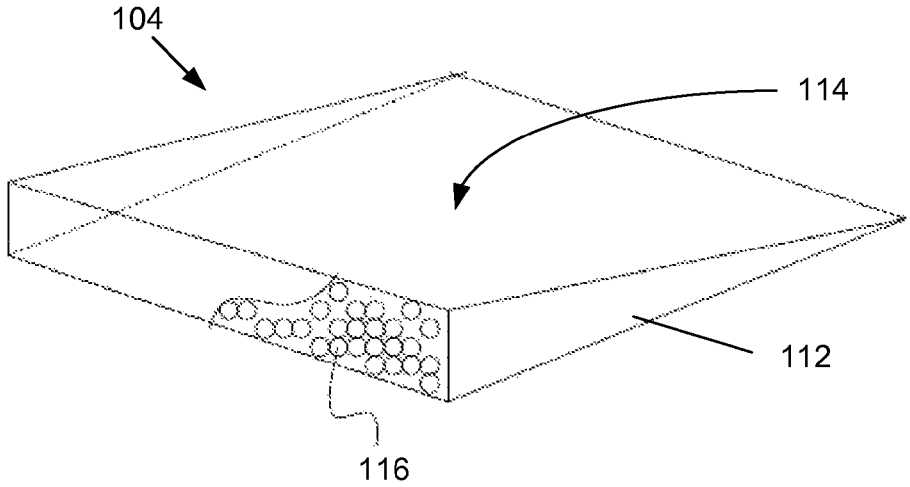
Figure 4C:
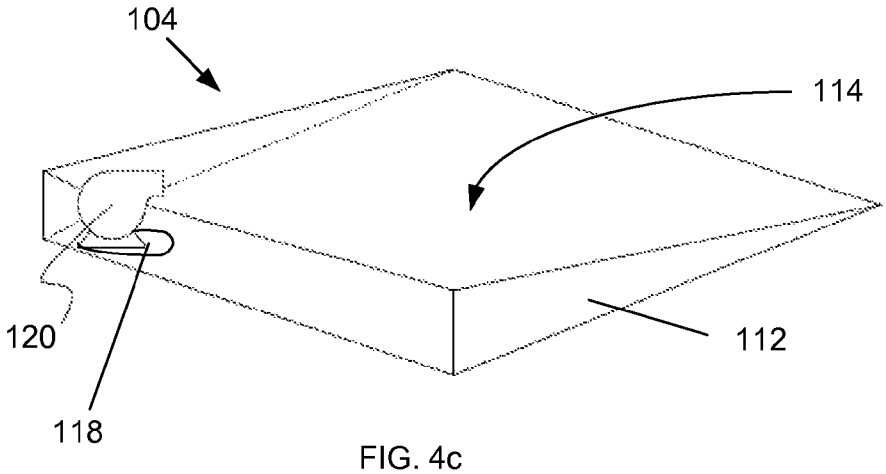

In alternate embodiments the central body 110 can be absent and the casing 112 of the support member 104 can define one or more interior chambers 114, as shown in FIGS. 4*a*-4*c*. The interior chambers 114 can be at least partially filled with filler material 116, as shown in FIG. 4*b*. The filler material 116 can be comprised of any desired gas, liquid, and/or solid. By way of non-limiting examples, in various embodiments the interior chambers 114 can be filled at least partially with filler material 116 comprising air, gel, closed-cell foam, open-cell foam, polystyrene, neoprene, water, fluid, beads, pellets, particulate matter, granular material, and/or any other known or desired material. In some embodiments, the filler material 116 can be at least partially compressible. In other embodiments, the filler material 116 can be substantially non-compressible.

In some embodiments, the casing 112 can have at least one opening 118. In some embodiments, the openings 118 can allow filler material 116 to enter and/or exit the interior chamber 114 or porous sections of the central body 110. In some embodiments, the opening 118 can be a valve. In alternate embodiments, the openings 118 can be breathable material, mesh material, apertures, or any other type of opening or access point that allows filler material 116 to enter and/or exit the support member 104. In some embodiments, the openings 118 can be selectively closed in order to retain the filler material 116 inside the support member 104.

In embodiments in which the filler material 116 is air, the air can enter and exit the support members 104 via the openings 118. In some embodiments, one or more pumps 120 can be coupled with the openings 118 in order to push and/or pull air from the support member 104, as shown in FIG. 4*c*. In some embodiments, the pump 120 can be a self-inflating mechanism, one-way valve, two-way valve, manual pump, hand cranked pump, motorized pump, blower, or any other inflating/deflating mechanism. In alternate embodiments, air can enter the support member 104 via a user blowing into the opening 118. In some embodiments, air can exit the support member 104 via the opening 118 when the support member 104 is compressed.

In some embodiments the shape of the support members 104 can be adjustable. In some embodiments, the shape of the support members 104 can be adjusted by moving some or all of the filler material 116 to a new configuration within the interior chambers 114. In other embodiments, the shape of the support members 104 can be adjusted by adding or removing filler material 116. In still other embodiments, the shape of the support members 104 can be adjusted by compressing and/or expanding the central body 110.

In some of these adjustable embodiments, the support members 104 can be adjusted between an expanded position, a contracted position, and/or any other intermediate position between the expanded position and the contracted position. In some embodiments of the adjustable pad 100 that comprise a plurality of support members 104, one or more individual support members 104 can be adjusted independently. Individual support members 104 in the expanded position can have a substantially triangular cross section as shown in FIG. 3*a*, substantially rectangular cross section as shown in FIG. 3*b*, or any other desired shape. In some embodiments, the casing 112 of the support member 104 can be substantially taut when the support member 104 is in the expanded position. Individual support members 104 in the contracted position can have a substantially triangular cross section as shown in FIG. 3*a*, substantially rectangular cross section as shown in FIG. 3*b*, or any other desired shape. In some embodiments, the casing 112 of the support member 104 can be at least partially slack when the support member 104 is in the contracted position.

Figure 5A:
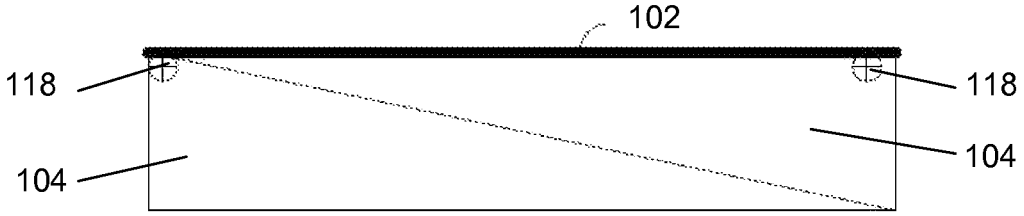
FIGS. 5*a*-5*d* depict an exemplary embodiment of the diaper changing pad in use.
Figure 5B:
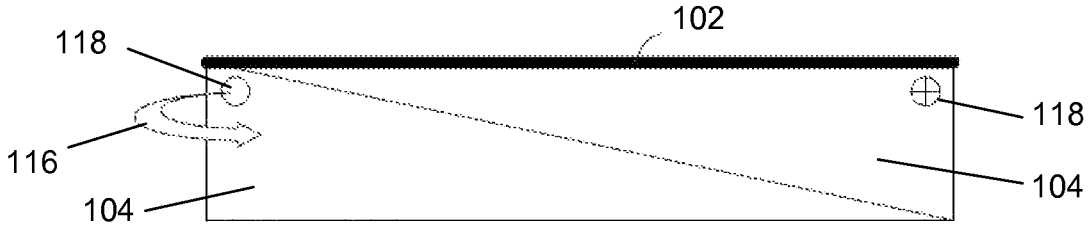
Figure 5C:
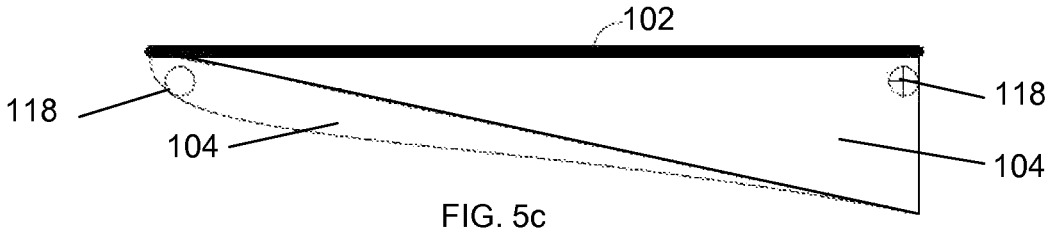
Figure 5D:
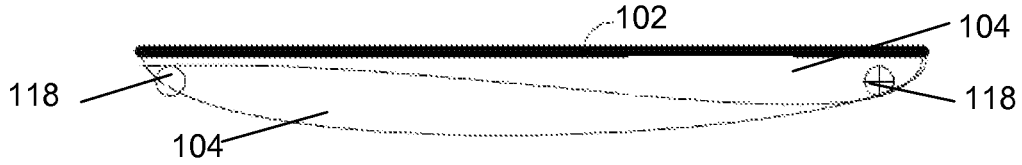

FIGS. 5*a*-5*d* depict an exemplary embodiment of the adjustable pad 100 in use. The support members 104 can begin in the expanded position, as shown in FIG. 5*a*. As shown in FIG. 5*b*, the opening 118 in one of the support members 104 can be opened to expel filler material 116, allowing the support member 104 to be moved toward the contracted position, as shown in FIG. 5*c*. If desired, the other support member 104 can also be moved toward the contracted position, as shown in FIG. 5*d*, by expelling the filler material 116 in that support member 104.

In some embodiments, the presence of the central body 110 and/or filler material 116 inside the casing 112 can cause the support member 104 to tend toward the expanded position. In these embodiments, the support member 104 can comprise one or more contraction mechanisms 122. The contraction mechanisms 112 can be used to move the support member 104 between the expanded position, intermediate positions, and the contracted position. In some embodiments, the contraction mechanisms 122 can be used to keep the support member 104 in the contracted position. In some embodiments, the casing 112 can be at least partially split and/or have extra sections. The contraction mechanisms 122 can operate to bring the split portions or extra sections of the casing 112 together and/or apart.

Figure 6A:
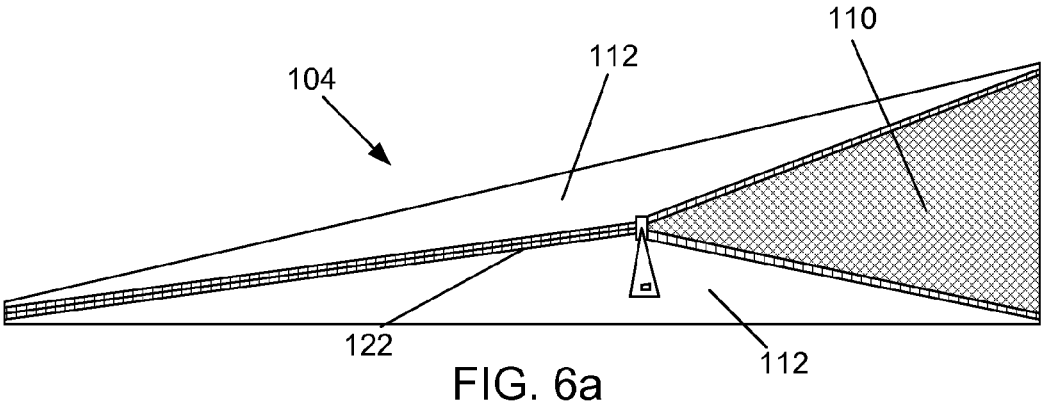
FIGS. 6*a*-6*c* depict an embodiment of the diaper changing pad moving between an expanded position and a contracted position.
Figure 6B:
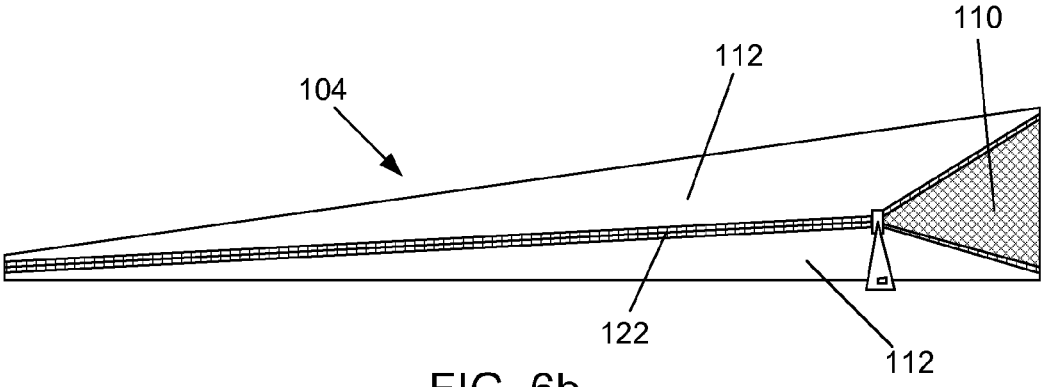
Figure 6C:
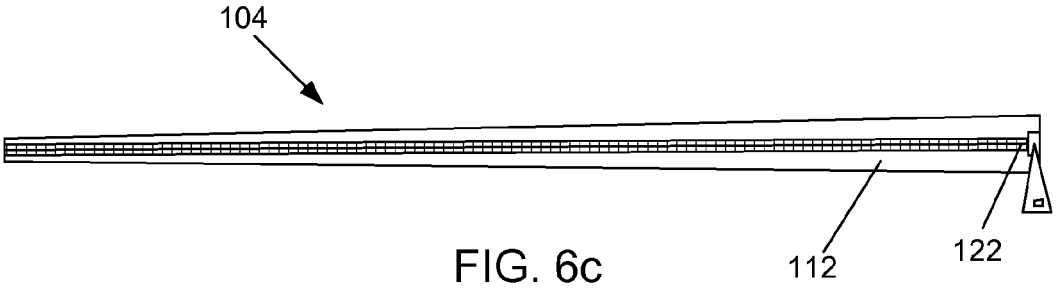

In some embodiments, the contraction mechanisms 122 can be one or more zippers that can join split edges or extra sections of the casing 112. As the zipper is moved along the split edges or extra sections to join the edges of the casing 112, the sides of the casing 112 can be brought closer together, thereby compressing the support member 104. If necessary, filler material 116 such as air can be expelled, and/or the filler material 116 or central body 110 can be compressed. By way of a non-limiting example, the wedge shaped support member 104 shown in FIGS. 6*a*-6*c* can be moved from the expanded position shown in FIG. 6*a* to the contracted position shown in FIG. 6*c* by moving the zipper from left to right. Similarly, the support member 104 can be moved from the contracted position shown in FIG. 6*c* to the expanded position shown in FIG. 6*a* by moving the zipper from right to left such that the split portions of the casing 112 are separated, thereby allowing filler material 116 such as air to enter the interior chamber 114 and/or allowing the filler material 116 or central body 110 to expand. The zipper can positioned at any point along the split edges of the casing 112 to move the support member 104 into any desired intermediate position, as shown in FIG. 6*b*.

Figure 7A:
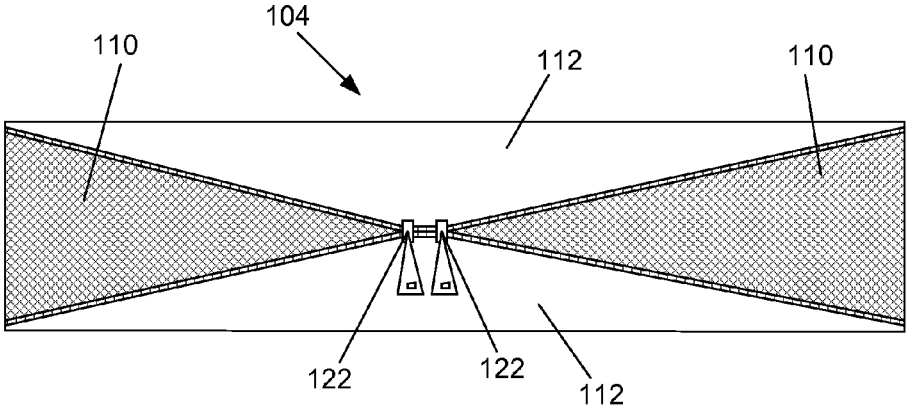
FIGS. 7*a*-7*d* depict an embodiment of the diaper changing pad moving between an expanded position and a contracted position.
Figure 7B:
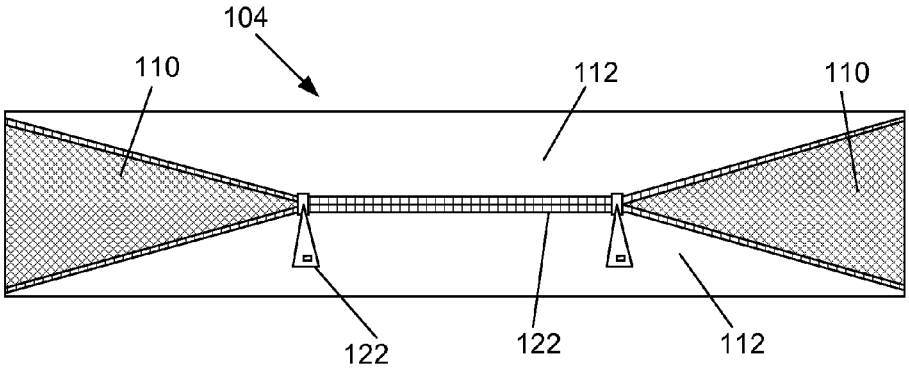
Figure 7C:
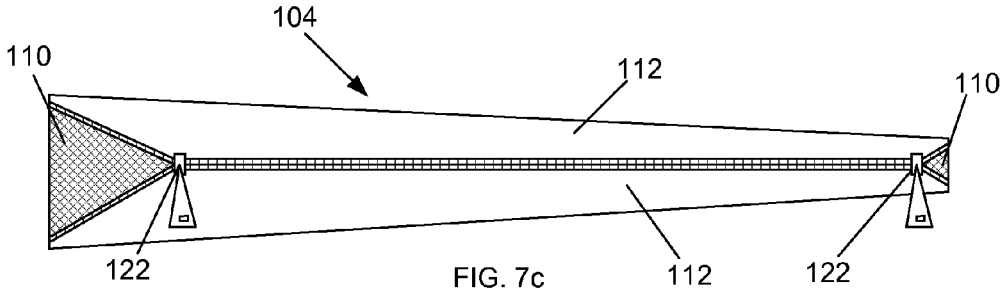
Figure 7D:
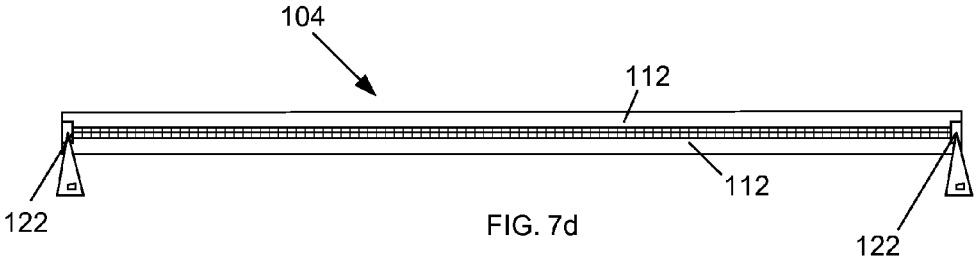

By way of another non-limiting example, the rectangular support member 104 shown in FIGS. 7*a*-7*d* can be moved from the expanded position to the contracted position by moving two zippers left and right from the midpoint shown in FIG. 7*a* towards the left and right sides of the support member 104 as shown in FIG. 7*d*. Similarly, the support member 104 can be moved from the contracted position to the expanded position by moving the zippers from the left and rights sides as shown in FIG. 7*d* toward the midpoint as shown in FIG. 7*a* such that the split edges of the casing 112 are separated, thereby allowing the filler material 116 such as air to enter the interior chamber 114 and/or allowing the filler material 116 or central body 110 to expand. The zippers can positioned at any point along the split edges of the casing 112 to move the support member 104 into any desired intermediate position, as shown in FIGS. 7*b* and 7*c*. If desired, the zippers can be moved independently such that an intermediate position having an at least partially wedged shape can be achieved by contracting one side of the support member 104 more than the other side, as shown in FIG. 7*c*.

Figure 8A:
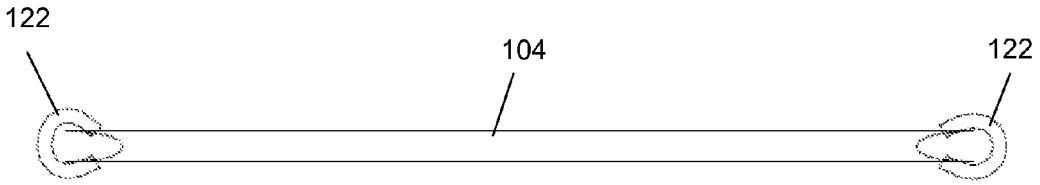
FIGS. 8*a*-8*d* depict embodiments of the diaper changing pad moving between an expanded position and a contracted position.
Figure 8B:
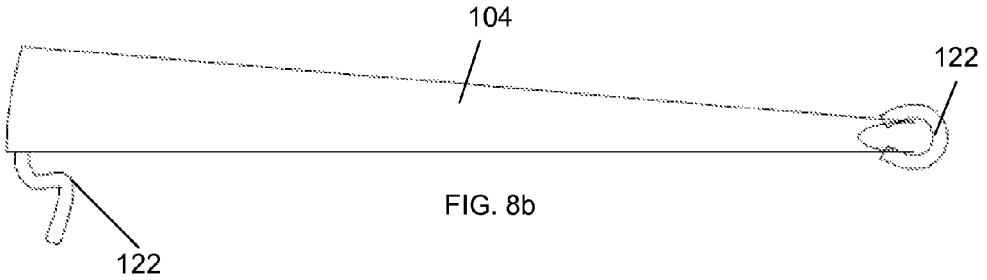
Figure 8C:
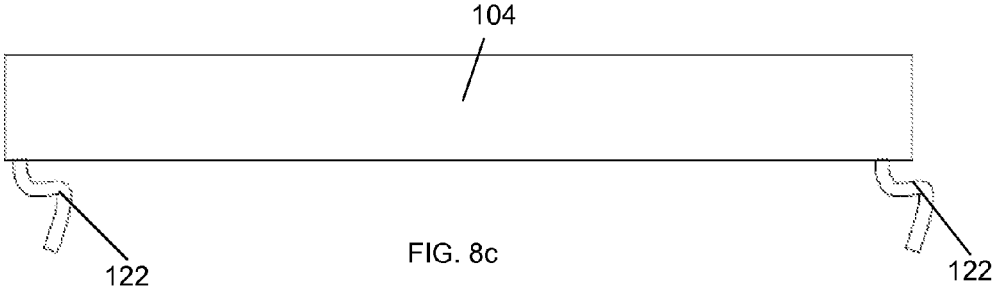
Figure 8D:
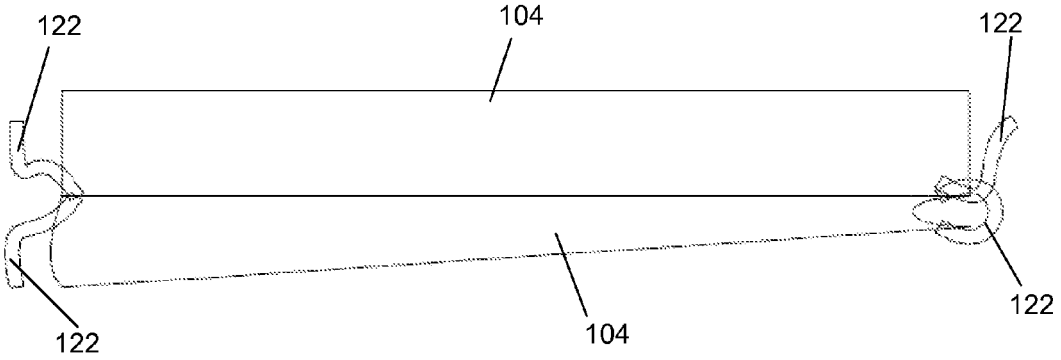

In alternate embodiments, the contraction mechanisms 122 can be straps, clips, sliders, brackets, snaps, buttons, hook and loop fasteners, strings, clasps, ratchets, clamps, and/or any other desired fastener or contraction mechanism. In some of these embodiments, the contraction mechanisms 122 can join and/or separate split or extra portions of the casing 112 as described above. In other embodiments, the contraction mechanisms 122 can bring the tops and bottoms of the support members 104 closer together in order to contract the support members 104. By way of a non-limiting example, in the embodiment shown in FIG. 8*a*-8*d*, the contraction mechanisms 122 can be straps. As shown in FIG. 8*a*, straps can be fastened to the bottom and top of the support member 104 on both sides to keep the support member 104 in the contracted position. As shown in FIG. 8*b*, one strap can be disconnected from one side of the support member 104, which can allow that side of the support member 104 to move toward the expanded position. As shown in FIG. 8*c*, the other strap can also be disconnected from the other side of the support member 104, which can allow the other side of the support member 104 to also move toward the expanded position. In some embodiments, more than one support member 104 can be present, and the contraction mechanisms 122 of each support member 104 can be manipulated independently. By way of a non-limiting example, in the embodiment depicted in FIG. 8*d* two support members can be coupled with one another, and the lower support member 104 is shown as being partially contracted on the right side while the upper support member 104 is shown in the expanded position.

FIGS. 9*a*-9*d* depict embodiments of methods of coupling the support members 104 with the sheet 102. In some embodiments, a support member 104 comprising one or more central bodies 110 or interior chambers 114 can be coupled with the bottom side of the sheet 102. By way of a non-limiting example, the embodiment shown in FIG. 9*a* has a support member 104 comprising a casing 112 that defines two interior chambers 114, and the support member 104 can be coupled with the sheet 102. In some embodiments, the support members 104 can be coupled with the sheet 102 with stitching. In other embodiments, the support members 104 can be coupled with the sheet 102 with adhesives, hook and loop fasteners, snaps, buttons, fusing, or any other type of connection mechanism.

In alternate embodiments, a first support member 104 can be coupled with the sheet 102, and a second support member 104 can be coupled with the first support member 104. By way of a non-limiting example, the embodiment shown in FIG. 9*b* comprises two wedge shaped support members 104. The upper support member 104 can be coupled with the sheet 102 and the lower support member 104 can be coupled with the upper support member 104. In this embodiment, the wedge shaped support members 104 can be arranged in a complimentary counter positioned configuration, such that the two support members 104 together can form a substantially rectangular shape.

Figure 9A:
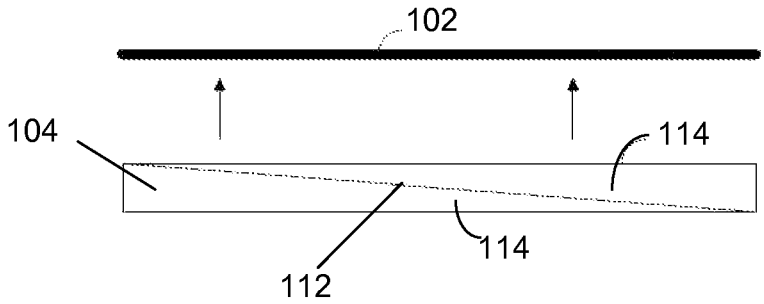
FIGS. 9*a*-9*d* depict embodiments of methods of coupling the support members with the sheet.
Figure 9B:
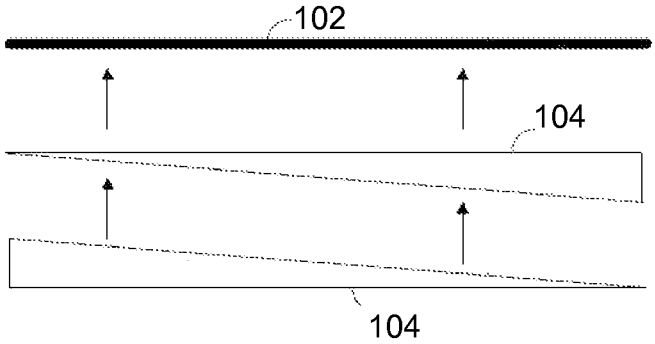
Figure 9C:
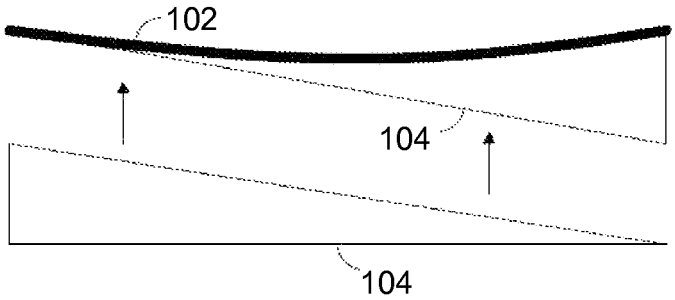

In some embodiments, the sheet 102 can be integral with one or more support members 104. By way of a non-limiting example, as shown in FIG. 9*c*, the upper support member 104 can have the sheet 102 integrated into the top of the upper support member 104, and a lower support member 104 can be coupled with the underside of the upper support member 104. In embodiments with a plurality of support members 104, the support members 104 can have different shapes. By way of a non-limiting example, the upper support member 104 can have a concave top while the lower support member 104 can have the cross section of a right triangle, as shown in FIG. 9*c*.

Figure 9D:
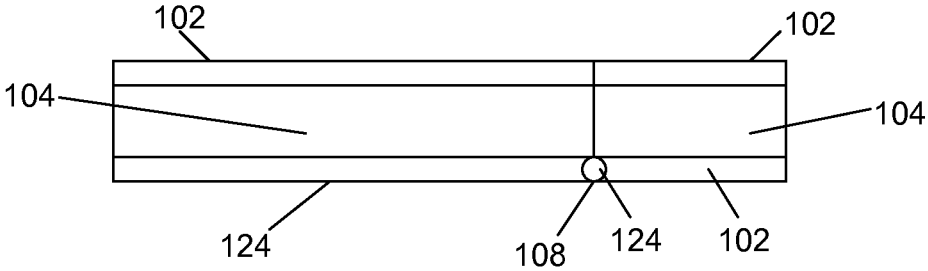

In still other embodiments, the support members 104 can be hingeably coupled with one another and/or with one or more sheets 102. By way of a non-limiting example, in the embodiment shown in FIG. 9*d*, two support members 104 can each be coupled with a separate sheet 102 at the tops of the support members 104, and the support members can be hingeably coupled with one another via a hinge mechanism 124. The support members can be of different sizes. In some embodiments, the hinge mechanism 124 can be a flexible material coupled with both support members 104, as shown in FIG. 9*d*. In some of these embodiments, the hinge mechanism 124 can be substantially similar to the sheet 102. In some embodiments, the hinge mechanism 124 can be the fold portions 108 in the sheet 102. In alternate embodiments, the hinge mechanism 124 can be a pin extending through an aperture or any other type of hinge.

FIGS. 10*a*-10*d* depict some exemplary embodiments of the adjustable pad 100. The support members 104 can be coupled with the sheet 102, such that the support members 104 can provide at least partial support to the sheet 102. In some embodiments a single support member 104 can be coupled with the sheet 102. In other embodiments, a plurality of support members 104 can be coupled with the sheet 102. In some embodiments, the support members 104 can be formed and/or adjusted to at least partially conform to a surface 126. The surface 126 can be any type of surface. In various embodiments, the surface 126 can be slanted, rough, hard, bumpy, variable, level, and/or have any other properties or configuration. In some embodiments, the surface 126 can be part of an existing structure. By way of a non-limiting example, the surface 126 can be a slanted portion of a vehicle's seat. In other embodiments, the surface 126 can be a natural formation. By way of a non-limiting example, the surface 126 can be a portion of the ground outdoors.

Figure 10A:
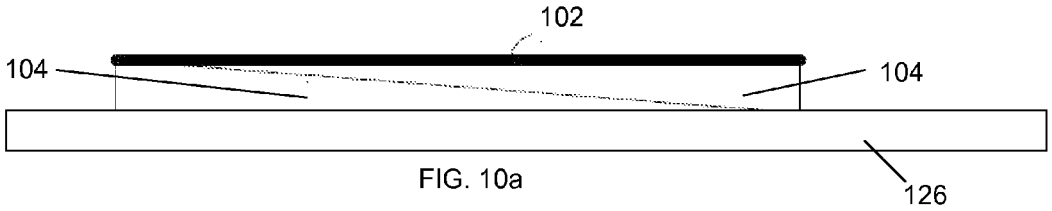
FIGS. 10*a*-10*d* depict exemplary embodiments of the diaper changing pad.
Figure 10B:
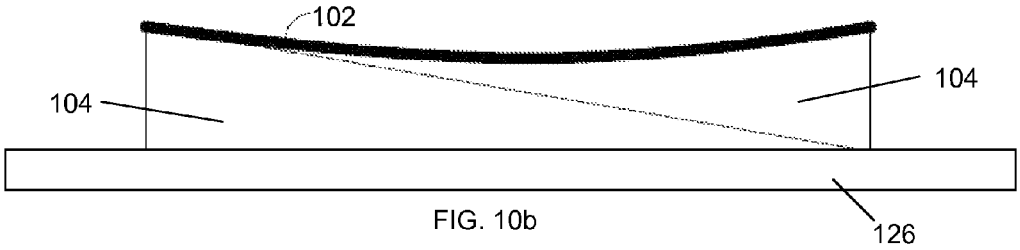
Figure 10C:
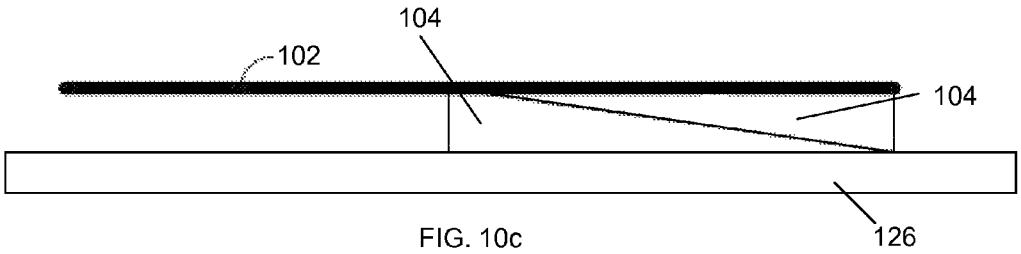
Figure 10D:
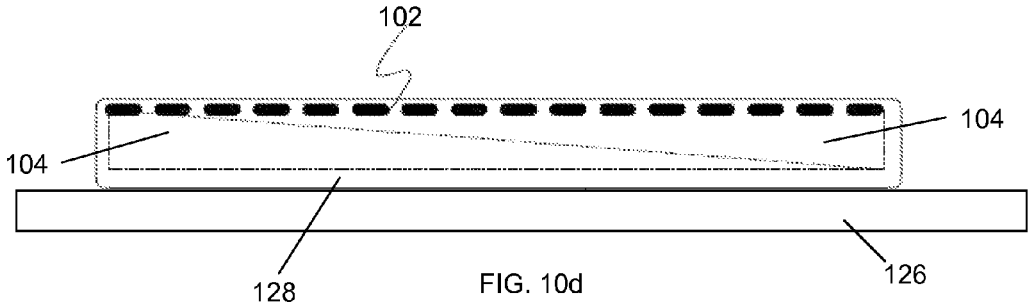

In some embodiments, one or more of the support members 104 can be formed and/or adjusted to change the gradient of the sheet 102, regardless of the slope or configuration of the surface 126. In some embodiments, the sheet 102 can be positioned in a substantially level configuration, as shown in FIG. 10*a*. In other embodiments, the support members 104 can be formed and/or adjusted such that the sheet 102 can have a concave depression, as shown in FIG. 10*b*. In some embodiments, as shown in FIG. 10*c*, the support members can be coupled with a portion of the sheet 102, such that the remainder of the sheet 102 is unsupported. In some embodiments, the adjustable pad 100 can be permanently or temporarily stored within an exterior cover 126, as shown in FIG. 10*d*.

Figure 11A:
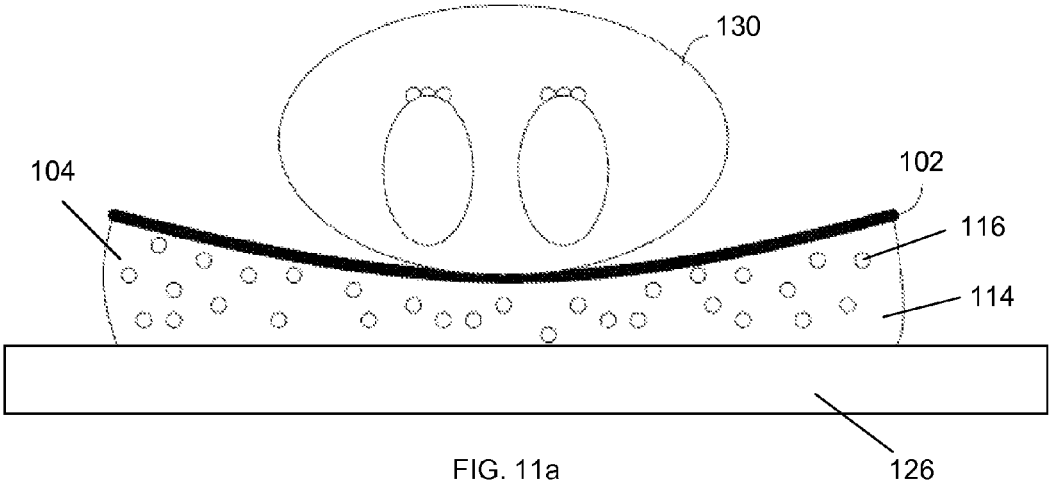
FIGS. 11*a* and 11*b* depicts an embodiment of the diaper changing pad in use.
Figure 11B:
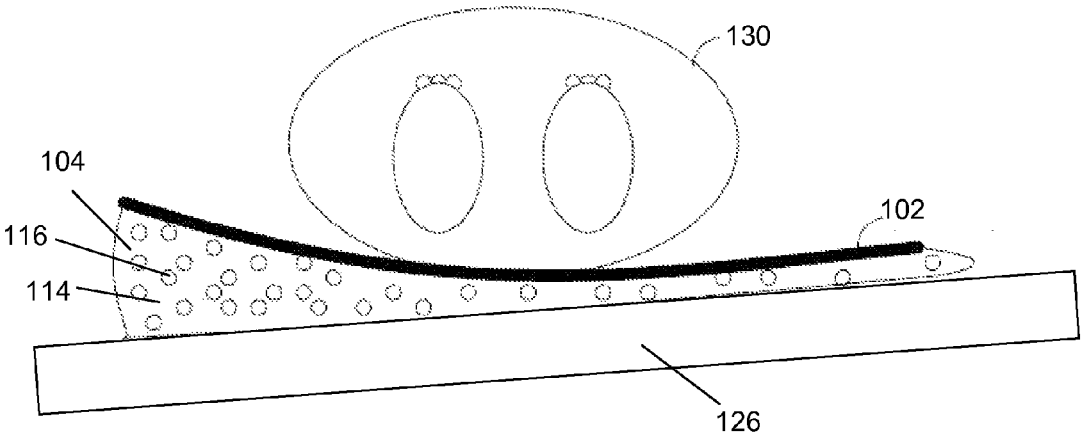

FIGS. 11*a* and 11*b* depicts an embodiment of the adjustable pad 100 in use. The adjustable pad 100 can be placed on a surface 126. The support members 104 can be formed and/or adjusted such that the sheet 102 is substantially level and/or has a concave depression regardless of the slope or other characteristics of the surface 126. In some embodiments, the user can then place a child 130 on the top of the sheet 102 in order to change the child 130's diaper, let the child 130 sleep and/or rest, clean the child 130, feed the child 130, or for any other desired reason. By way of a non-limiting example, the adjustable pad 100 can have a concave sheet 102 such that the potential for a child to roll is limited despite a flat surface 126, as shown in FIG. 11*a*. By way of another non-limiting example, the adjustable pad 100 can have a concave sheet 102 such that the potential for a child to roll is limited despite a slanted surface 126, as shown in FIG. 11*b*. In other embodiments, the adjustable pad 100 can be used in non-childcare situations, such that a user can sleep on the sheet 102 on uneven and/or uncomfortable surfaces 126, for example while camping; rest items on the sheet 102 regardless of the characteristics of the surface 126; use the adjustable pad 100 as a mattress pad; or use the adjustable pad 100 for any other desired purpose.

Figure 12A:
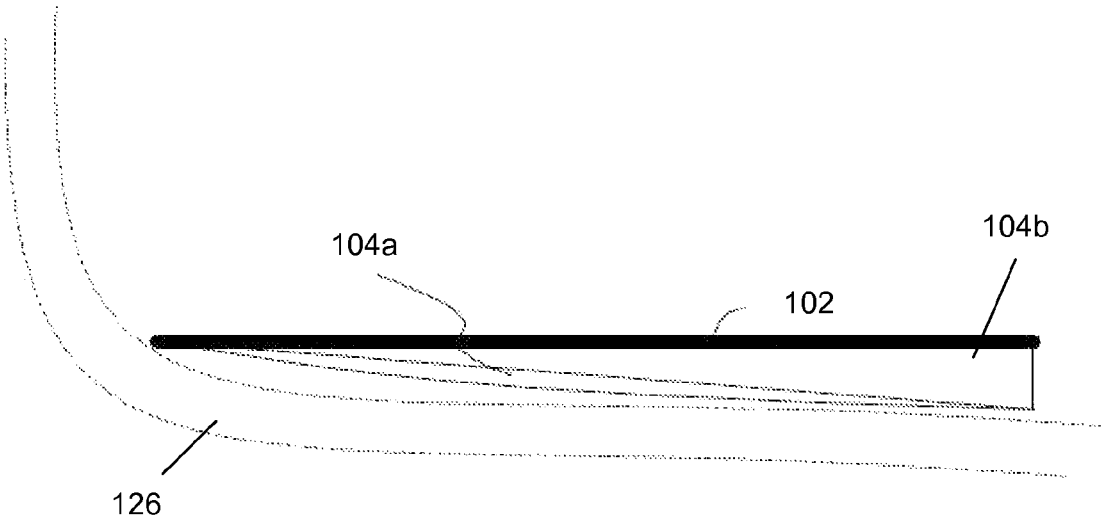
FIGS. 12*a* and 12*b* depict examples of an embodiment of the diaper changing pad in use.
Figure 12B:
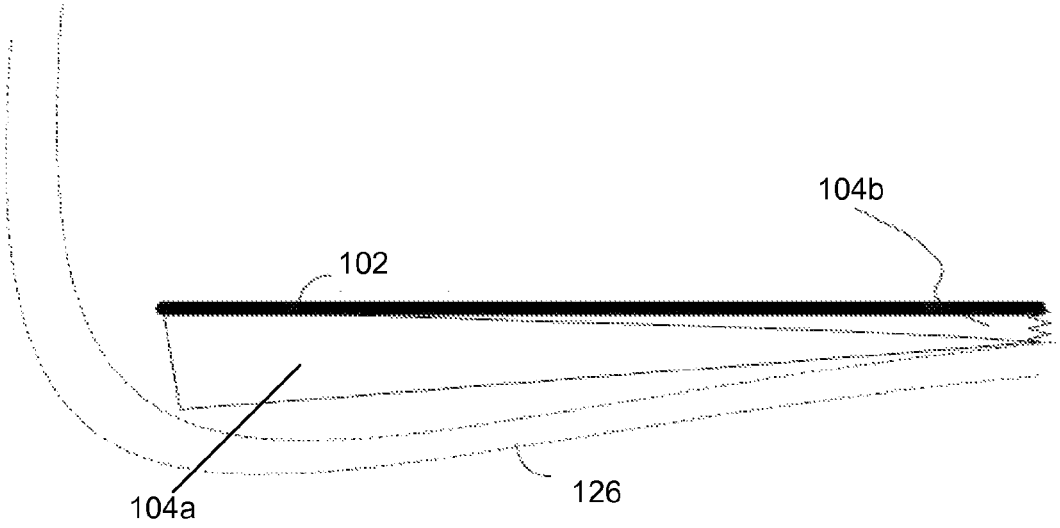

FIGS. 12*a* and 12*b* depict examples of an embodiment of the adjustable pad 100 in use. In the example shown in FIG. 12*a*, the surface 126 is the seat of a chair that is angled forward, such that the sitting surface slants downward toward the front of the chair. In order to position the sheet 102 in a substantially level configuration despite the slope of the chair seat, the support member 104*a* can be moved to the contracted position while the support member 104*b* can be moved to the expanded position. The adjustable pad 100 can be used with a child or other user in the manner described with respect to FIGS. 11*a*-11*b*. Similarly, in the example shown in FIG. 12*b* the surface 126 is the seat of a chair that is angled backward, such that the sitting surface slants upward toward the front of the chair. In order to position the sheet 102 in a substantially level configuration despite the slope of the chair seat, the support member 104*a* can be moved to the expanded position while the support member 104*b* can be moved to the contracted position. The adjustable pad 100 can be used with a child or other user in the manner described with respect to FIGS. 11*a*-11*b*.

Figure 13A:
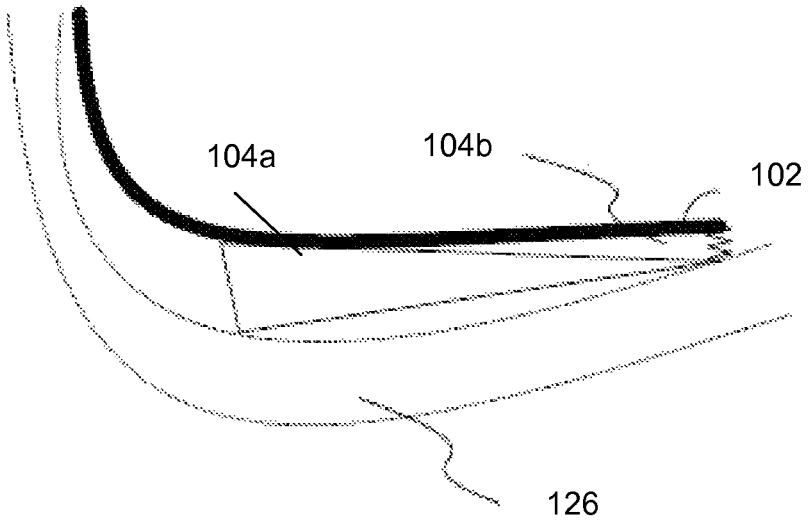
FIGS. 13*a* and 13*b* depict examples of an embodiment of the diaper changing pad in use.
Figure 13B:
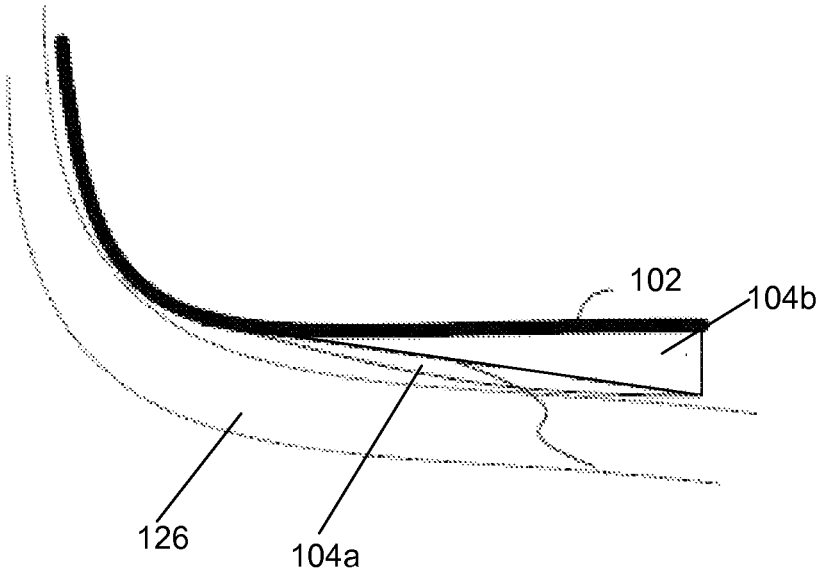

FIGS. 13*a* and 13*b* depict examples of an embodiment of the adjustable pad 100 in use. In this non-limiting exemplary embodiment, the support members 104 can be coupled with a portion of the sheet 102, such that the remainder of the sheet 102 is unsupported, as shown in FIG. 10*c*. In the example shown in FIG. 13*a*, the surface 126 is the seat of a chair that is angled backward, such that the sitting surface slants upward toward the front of the chair. In order to position the sheet 102 in a partially level configuration despite the slope of the chair seat, the support member 104*a* can be moved to the expanded position while the support member 104*b* can be moved to the contracted position. The remainder of the sheet 102 can be positioned to cover other surfaces of the chair, such as the back of the chair and/or the front of the chair. The adjustable pad 100 can be used with a child or other user in the manner described with respect to FIGS. 11*a*-11*b*. Similarly, in the example shown in FIG. 13*b*, the surface 126 is the seat of a chair that is angled forward, such that the sitting surface slants downward toward the front of the chair. In order to position the sheet 102 in a partially level configuration despite the slope of the chair seat, the support member 104*a* can be moved to the contracted position while the support member 104*b* can be moved to the expanded position. The remainder of the sheet 102 can be positioned to cover other surfaces of the chair, such as the back of the chair and/or the front of the chair. The adjustable pad 100 can be used with a child or other user in the manner described with respect to FIGS. 11*a*-11*b*.

Figure 14A:
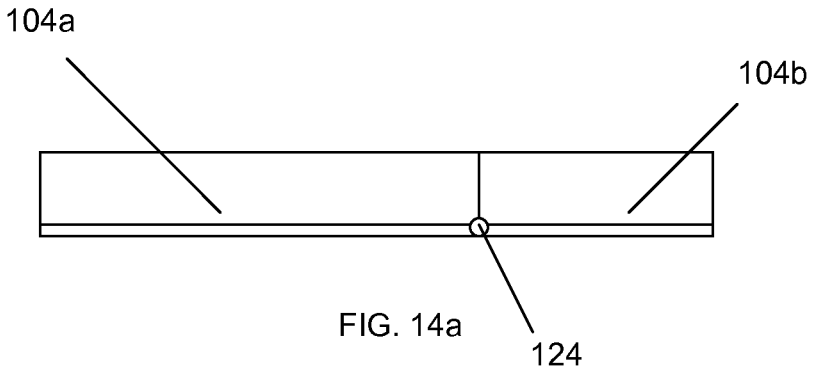
FIGS. 14*a*-14*c* depict an example of an embodiment of the diaper changing pad in use.
Figure 14B:
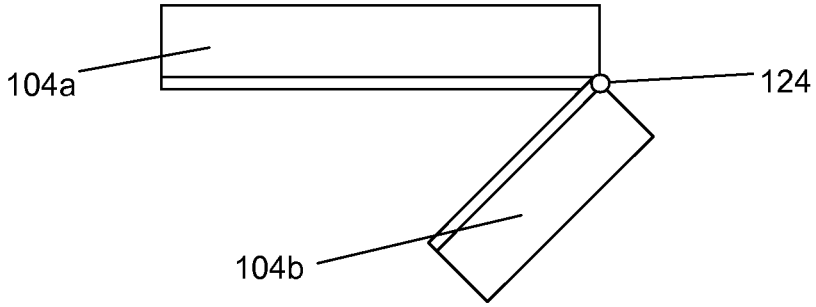
Figure 14C:
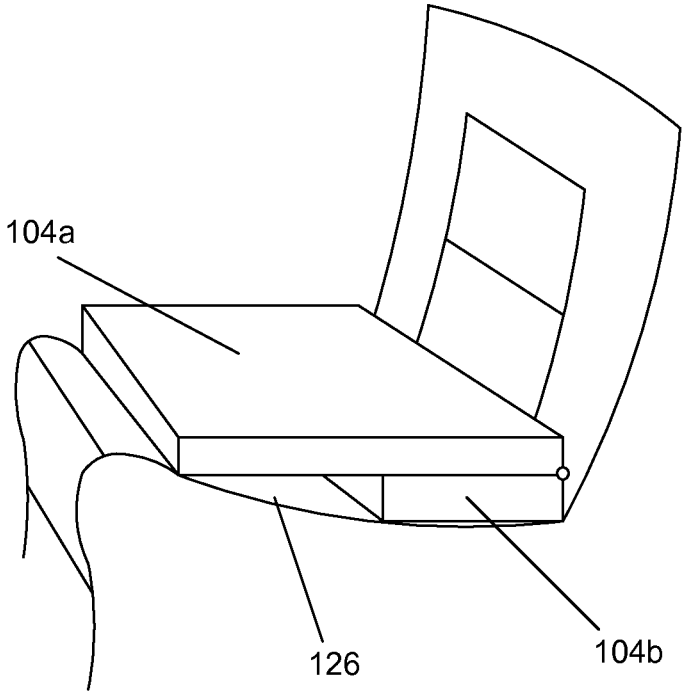

FIGS. 14*a*-14*c* depict an example of an embodiment of the adjustable pad 100 in use. In this non-limiting exemplary embodiment, the support members 104 can be hingeably coupled, as shown in FIG. 9*d*. The adjustable pad 100 can be used on a flat surface 126 in the configuration shown in FIG. 14*a*. If the surface 126 is slanted, the support member 104*b* can be rotated such that it is below the support member 104*a*, as shown in FIG. 14*b*. The adjustable pad 100 can then be placed on the slanted surface 126 as shown in FIG. 14*c*, such that the top of the support member 104*a* is substantially level due to the presence of the support member 104*b* underneath a portion of it. The adjustable pad 100 can be used with a child or other user in the manner described with respect to FIGS. 11*a*-11*b*.

Figure 15A:
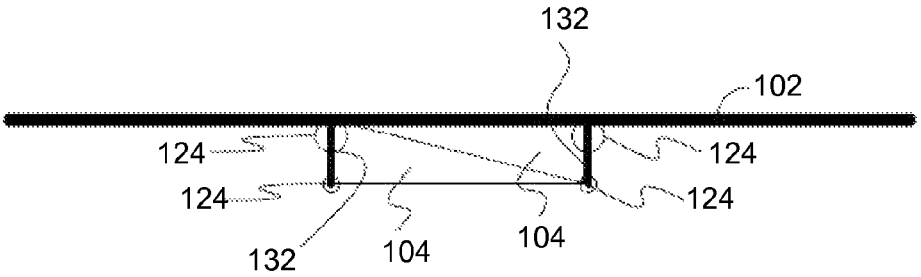
FIGS. 15*a*-15*d* depict an embodiment of the diaper changing pad in use.
Figure 15B:
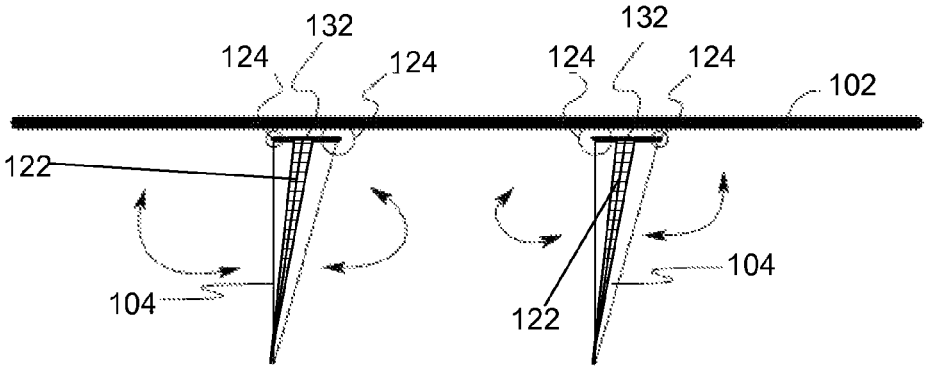
Figure 15C:
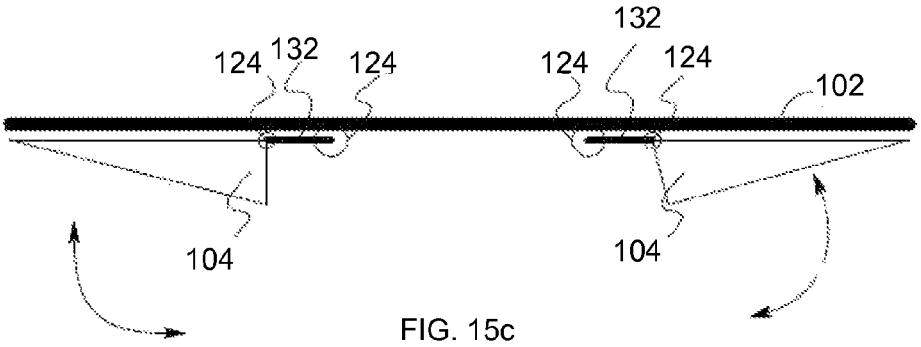
Figure 15D:
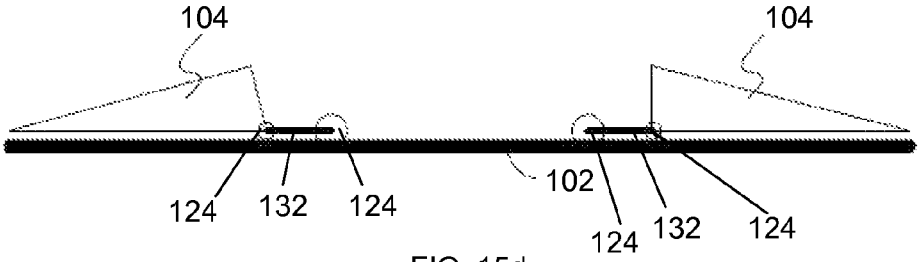

FIGS. 15*a*-15*d* depict an embodiment of the adjustable pad 100 in use. In this non-limiting exemplary embodiment, each of the support members 104 can be hingeably coupled to an intermediate extension 132 with hinge mechanisms 124, and the intermediate extensions 132 can be hingeably coupled to the sheet 102 with hinge mechanisms 124. As shown in FIG. 15*a*, the support members 104 can be positioned against one another such that together they support at least a portion of the sheet 102. If desired, the adjustable pad 100 can be placed on a surface 126 in this configuration in order to use the adjustable pad 100 with a child or other user in the manner described with respect to FIGS. 11*a*-11*b*. Alternatively, the support members 104 and the intermediate extensions 132 can be rotated about the hinge mechanisms 124 as shown in FIG. 15*b*, such that the support members 104 rest against the underside of the sheet 102 at the sides of the sheet 102, as shown in FIG. 15*c*. The support members 104 can then be placed on a surface 126 in order to use the adjustable pad 100 with a child or other user in the manner described with respect to FIGS. 11*a*-11*b*. Additionally, the adjustable pad 100 can be inverted and the sheet 102 can be placed against the surface 126, such that the support members 104 can be above the sheet 102, as shown in FIG. 15*d*. In this configuration, the child 130 or other user can rest on top of the sheet 102 between the support members 104, such that the child 130 or other user cannot easily roll past the support members 104. In some embodiments, the support members 104 can further comprise contraction mechanisms 122.

Figure 16A:
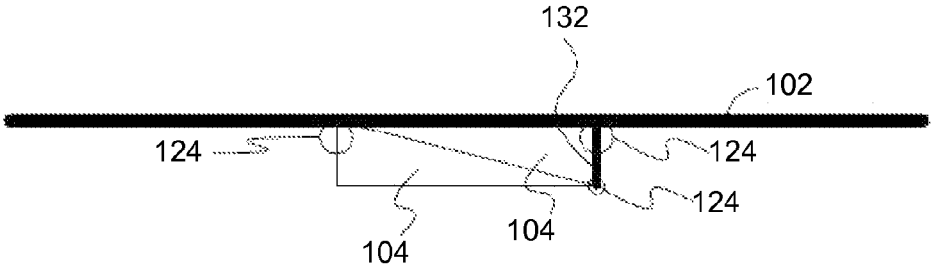
FIGS. 16*a*-16*d* depict an embodiment of the diaper changing pad in use.
Figure 16B:
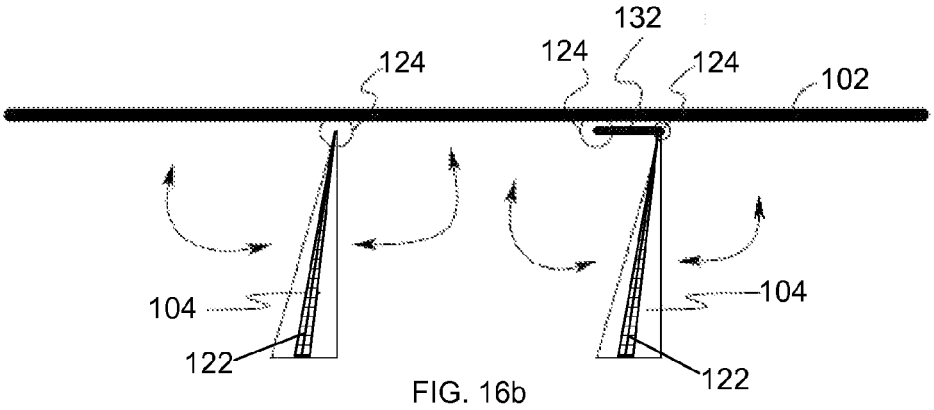
Figure 16C:
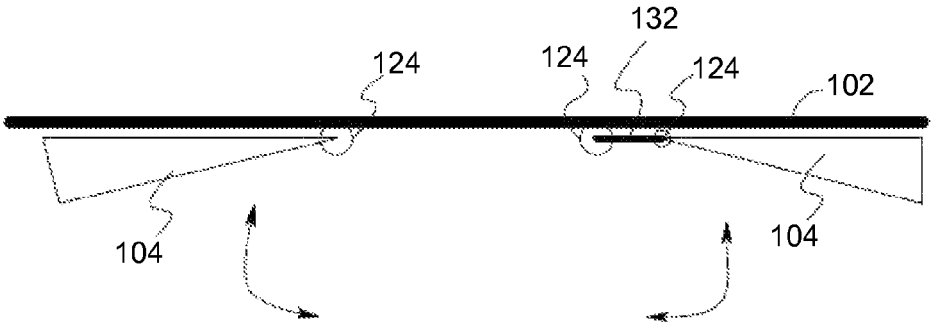
Figure 16D:
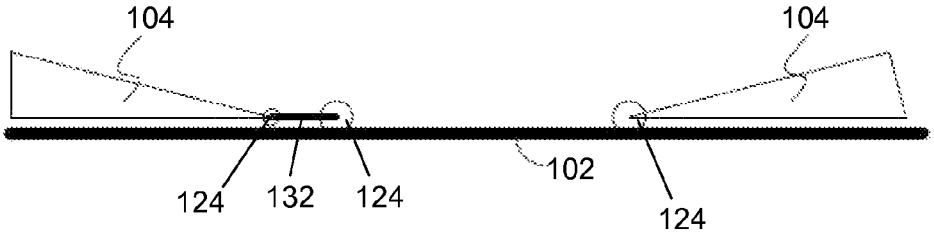

FIGS. 16*a*-16*d* depict an embodiment of the adjustable pad 100 in use. In this non-limiting exemplary embodiment, one of the support members 104 can be hingeably coupled to an intermediate extension 132 with hinge mechanisms 124. The intermediate extension 132 can be in turn be hingeably coupled to the sheet 102 with hinge mechanisms 124. The other support member 104 can be directly hingeably coupled with the sheet 102 with hinge mechanisms 124. As shown in FIG. 16*a*, the support members 104 can be positioned against one another such that together they support at least a portion of the sheet 102. If desired, the adjustable pad 100 can be placed on a surface 126 in this configuration in order to use the adjustable pad 100 with a child or other user in the manner described with respect to FIGS. 11*a*-11*b*. Alternatively, the support members 104 and the intermediate extension 132 can be rotated about the hinge mechanisms 124 as shown in FIG. 16*b*, such that the support members 104 rest against the underside of the sheet 102 at the sides of the sheet 102, as shown in FIG. 16*c*. The support members 104 can then be placed on a surface 126 in order to use the adjustable pad 100 with a child or other user in the manner described with respect to FIGS. 11*a*-11*b*. Additionally, the adjustable pad 100 can be inverted and the sheet 102 can be placed against the surface 126, such that the support members 104 can be above the sheet 102, as shown in FIG. 16*d*. In this configuration, the child 130 or other user can rest on top of the sheet 102 between the support members 104, such that the child 130 or other user cannot easily roll past the support members 104. In some embodiments, the support members 104 can further comprise contraction mechanisms 122.

Figure 17A:
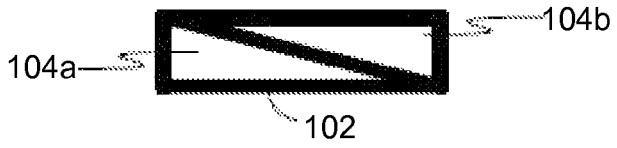
FIGS. 17*a*-17*d* depict an embodiment of the diaper changing pad in use.
Figure 17B:
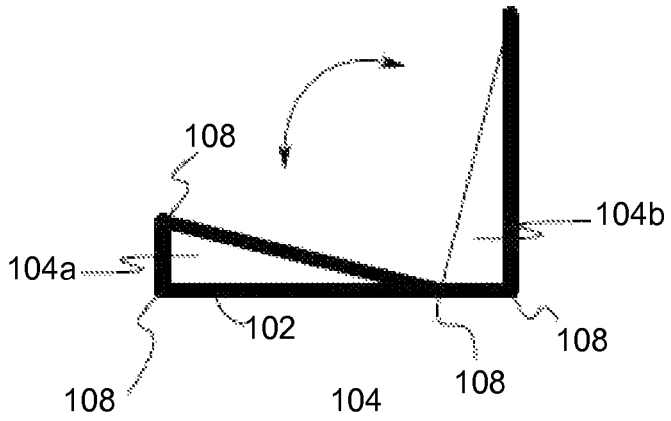
Figure 17C:
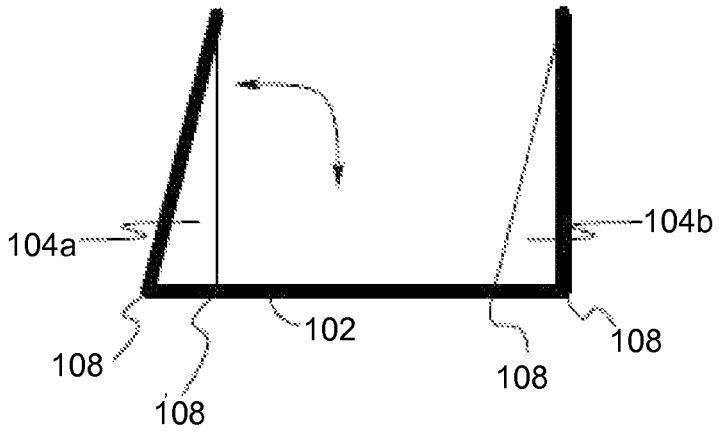
Figure 17D:
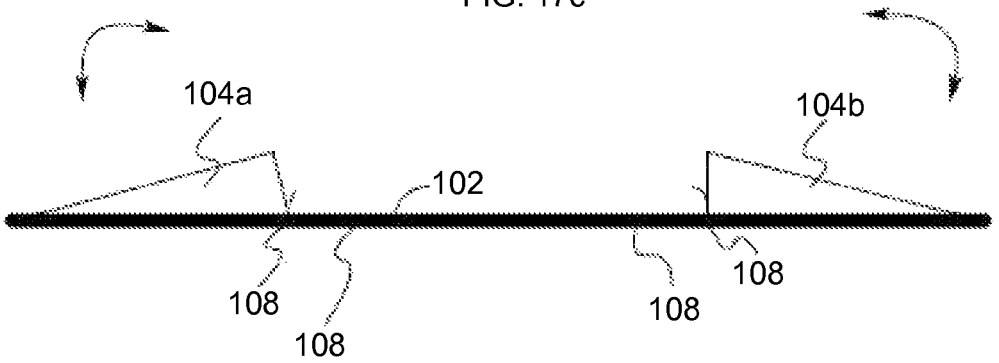

FIGS. 17*a*-17*d* depict an embodiment of the adjustable pad 100 in use. In this non-limiting exemplary embodiment, the support members 104 can have a wedge shape with the cross section of a right triangle. In this exemplary embodiment, the surface of support member 104*a* corresponding to the hypotenuse side of the right triangle can be directly coupled with the sheet 102, and the surface of support member 104*b* corresponding to one of the non-hypotenuse legs of the right triangle can be directly coupled with the sheet 102. As shown in FIG. 17*a*, the sheet 120 can be folded such that the support members 104 can be folded within the sheet 120. If desired, the adjustable pad 100 can be placed on a surface 126 in this configuration in order to use the adjustable pad 100 with a child or other user in the manner described with respect to FIGS. 11*a*-11*b*. Alternatively, as shown in FIGS. 17*b*-*c*, the support members 104 can be rotated away from one another, such that the support members 104 can be on opposing ends of the sheet 102. In some embodiments, the sheet 102 can be flexible enough to allow the support members 104 to be rotated. In other embodiments, the sheet can comprise hinge mechanisms 124 that allow sections of the sheet 102 to be rotated. In still other embodiments, the sheet can comprise fold portions 108. When the adjustable pad 100 has been unfolded, it can be placed on a surface 126 in order to use the adjustable pad 100 with a child or other user in the manner described with respect to FIGS. 11*a*-11*b*. Additionally, the adjustable pad 100 can be inverted and the sheet 102 can be placed against the surface 126, such that the support members 104 can be above the sheet 102, as shown in FIG. 17*d*. In this configuration, the child 130 or other user can rest on top of the sheet 102 between the support members 102, such that the child 130 or other user cannot easily roll past the support members 104. In some embodiments, the support members 104 can further comprise contraction mechanisms 122.

Figure 18A:
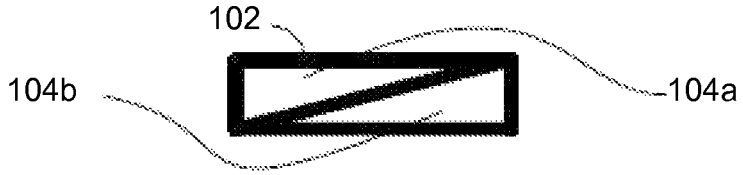
FIGS. 18*a*-18*d* depict an embodiment of the diaper changing pad in use.
Figure 18B:
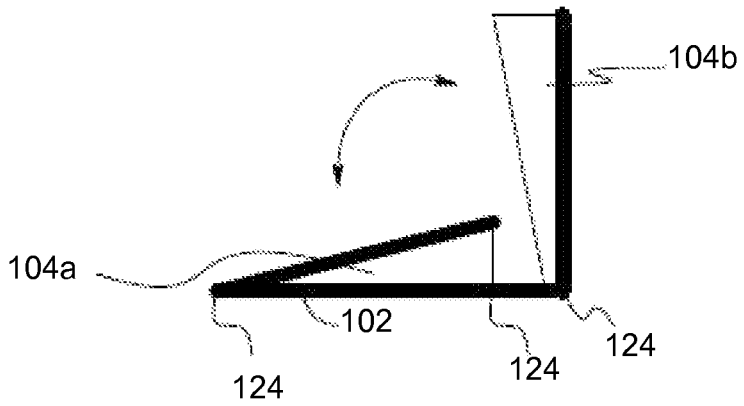
Figure 18C:
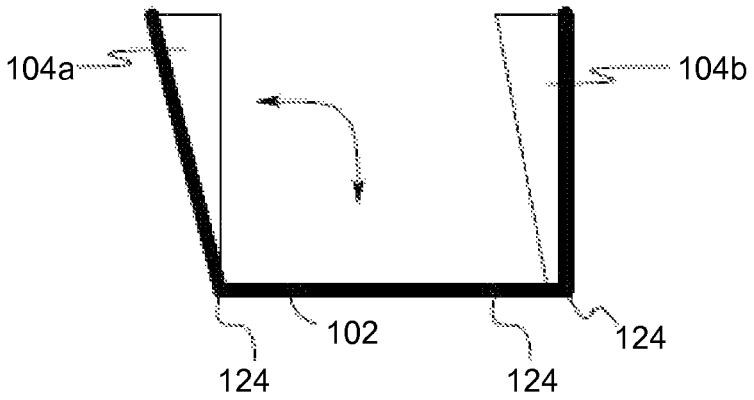
Figure 18D:
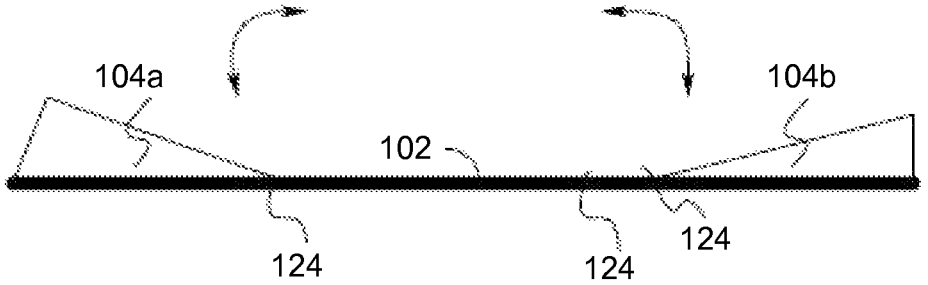

FIGS. 18*a*-18*d* depict an embodiment of the adjustable pad 100 in use. In this non-limiting exemplary embodiment, the support members 104 can have a wedge shape with the cross section of a right triangle. In this exemplary embodiments, the surface of support member 104*a* corresponding to the hypotenuse side of the right triangle can be directly coupled with the sheet 102, and the surface of support member 104*b* corresponding to one of the non-hypotenuse legs of the right triangle can be directly coupled with the sheet 102. As shown in FIG. 18*a*, the sheet 120 can be folded such that the support members 104 can be folded within the sheet 120. If desired, the adjustable pad 100 can be placed on a surface 126 in this configuration in order to use the adjustable pad 100 with a child or other user in the manner described with respect to FIGS. 11*a*-11*b*. Alternatively, as shown in FIGS. 18*b*-*c*, the support members 104 can be rotated away from one another, such that the support members 104 can be on opposing ends of the sheet 102. In some embodiments, the sheet 102 can be flexible enough to allow the support members 104 to be rotated. In other embodiments, the sheet can comprise hinge mechanisms 124 that allow sections of the sheet 102 to be rotated. In still other embodiments, the sheet can comprise fold portions 108. When the adjustable pad 100 has been unfolded, it can be placed on a surface 126 in order to use the adjustable pad 100 with a child or other user in the manner described with respect to FIGS. 11*a*-11*b*. Additionally, the adjustable pad 100 can be inverted and the sheet 102 can be placed against the surface 126, such that the support members 104 can be above the sheet 102, as shown in FIG. 18*d*. In this configuration, the child 130 or other user can rest on top of the sheet 102 between the support members 102, such that the child 130 or other user cannot easily roll past the support members 104. In some embodiments, the support members 104 can further comprise contraction mechanisms 122.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. An adjustable pad, comprising:

a sheet;

a second inflatable wedge-shaped support member;

wherein said first inflatable wedge-shaped support member has a first surface extending along a first side of said first inflatable wedge-shaped support member that is entirely fixed to said sheet, wherein said first inflatable wedge-shaped support member and said second inflatable wedge-shaped support member each have a second surface extending along a second side of said first inflatable wedge-shaped support member and said second inflatable wedge-shaped support member, said second surface being longer than said first surface, wherein the second surface of said first inflatable wedge-shaped support member is entirely and directly fixed to the second surface of said second inflatable wedge-shaped support member, and wherein said first inflatable wedge-shaped support member and said second inflatable wedge-shaped support member are configured to be at least partially inflated and/or deflated to select the gradient of said sheet relative to the configuration of a surface upon which said adjustable pad is placed.

2. The adjustable pad of claim 1, wherein said first inflatable wedge-shaped support member and said second inflatable wedge-shaped support member are configured to be at least partially inflated and/or deflated to adjust the gradient of said sheet to be substantially level regardless of the slope of said surface.

3. The adjustable pad of claim 1, wherein said first inflatable wedge-shaped support member and said second inflatable wedge-shaped support member are configured to be at least partially inflated and/or deflated to adjust the sheet to have a concave portion regardless of the slope of said surface.

4. The adjustable pad of claim 1, wherein at least one of said first inflatable wedge-shaped support member and said second inflatable wedge-shaped support member comprise a casing defining an interior chamber.

5. The adjustable pad of claim 1, wherein at least one of said first inflatable wedge-shaped support member and said second inflatable wedge-shaped support member are self-inflating.

6. The adjustable pad of claim 4, wherein said casing has one or more apertures configured to allow air to enter and/or exit the interior chamber.

7. The adjustable pad of claim 6, wherein at least one of said first inflatable wedge-shaped support member and said second inflatable wedge-shaped support member comprise a pump configured to pump said air into and/or out of said interior chamber through said apertures.

8. The adjustable pad of claim 1, wherein said adjustable pad is configured to be adjusted between an expanded position, a contracted position, and an intermediate position by adjusting the inflation levels of said first inflatable support member and/or said second inflatable wedge-shaped support member.

* * * * *